United States Patent [19]

Reid

[11] Patent Number: 4,972,544

[45] Date of Patent: Nov. 27, 1990

[54] AIR POWERED VACUUM CLEANING TOOL

[75] Inventor: William J. Reid, Dallas, Tex.

[73] Assignee: M & S Systems, Inc., Dallas, Tex.

[21] Appl. No.: 322,347

[22] Filed: Mar. 13, 1989

[51] Int. Cl.[5] ..... A47L 5/30

[52] U.S. Cl. ..... 15/387; 15/381

[58] Field of Search ..... 15/387, 381

[56] References Cited

U.S. PATENT DOCUMENTS 2,514,142 7/1950 Reid ..... 15/381 X
3,346,907 10/1967 Groves et al. ..... 15/381
3,688,338 9/1972 Lundvall ..... 15/381 X
4,272,861 6/1981 Notta et al. ..... 15/381 X

*Primary Examiner*—Chris K. Moore
*Attorney, Agent, or Firm*—John E. Vandigriff

[57] ABSTRACT

A positive displacement air motor providing power to a rotating brush, brush agitator, or flexible blades for use in cleaning carpets, tile or wooden floors, upholstery, and drapes, allowing such air powered cleaning device to completely function with only the air provided by a vacuum cleaning motor or system.

14 Claims, 3 Drawing Sheets

AIR POWERED VACUUM CLEANING TOOL

FIELD OF THE INVENTION

This invention relates to vacuum cleaning systems and more particularly to a vacuum powered brush system for use in vacuum cleaning apparatus.

BACKGROUND OF THE INVENTION

Power for brush or blade devices used in vacuum cleaning is commonly provided by fractional horsepower electric motors or by a turbine air motor. The brush or blade is usually driven by a belt powered by the electric or turbine air motor.

Electric motors require an electric cord connection between a wall or other outlet and the brush or blade device. This electric cord is inconvenient to use and presents an additional safety hazard.

The turbine air motor converts air flow energy into rotary motion through a momentum transfer between the turbine moving surfaces and the air. Turbine air motors are ineffective in providing power at low speeds and/or at low air flows. Therefore, turbine air motors run at high speeds, compared to a speed necessary for a carpet cleaning, generating an objectionable noise and performing poorly when heavily loaded. Turbine air motors require high air flow and do not adequately function on lower powered vacuum cleaners or systems.

Both the electric and air powered turbine motors provide a rotary motion to, for example, a brush to agitate the dust and objects to be picked-up by the vacuum system. The brush may be belt driven or directly driven by the electric motor or air turbine.

The objective of the invention is to overcome the shortcomings of the prior art brush/blade vacuum cleaning device motors and to provide a more convenient, safer air powered brush/blade cleaning device that can be used with a broader range of cleaning devices and systems.

BRIEF SUMMARY OF THE INVENTION

The invention utilizes a positive displacement air motor as the power source in a brush/blade vacuum cleaning device. In a positive displacement air motor a distinct constant volume of air is isolated and evacuated to produce mechanical force. This is in contrast to a turbine which uses air motion to cause movement. The positive displacement air motor works by differential pressure across a displaceable element. At stall, a positive displacement air motor generates maximum force while a turbine generates significantly less than maximum force.

The positive displacement air motor of the present invention consist of two movable cavities separated by a fixed vane. The two movable cavities define a housing to which brushes are attached. A control valve directs the applied vacuum source so that all or a portion of the vacuum is allowed to evacuate the air in alternate cavities and/or the cavity opening to the surface to be cleaned. The control valve is implemented by a rotary valve which is rotated or oscillated as the vacuum housing moves over the surface being cleaned.

The alternating evacuation of the cavities, as the valve rotates, causes the cavity being evacuated to move toward the fixed vane and then the other cavity being evacuated to move toward the vane. The action of the rotary valve connects the cavity not being evacuated to the atmosphere at the carpet.

The movement of the housing defined by the two cavities causes the attached brush to move in an oscillating motion across the surface to be cleaned.

The technical advance represented by the invention as well as the objects thereof will become apparent from the following description of a preferred embodiment of the invention when considered in conjunction with the accompanying drawings, and the novel features set forth in the appended claims.

DESCRIPTION OF A PREFERRED EMBODIMENT

Figure 1:
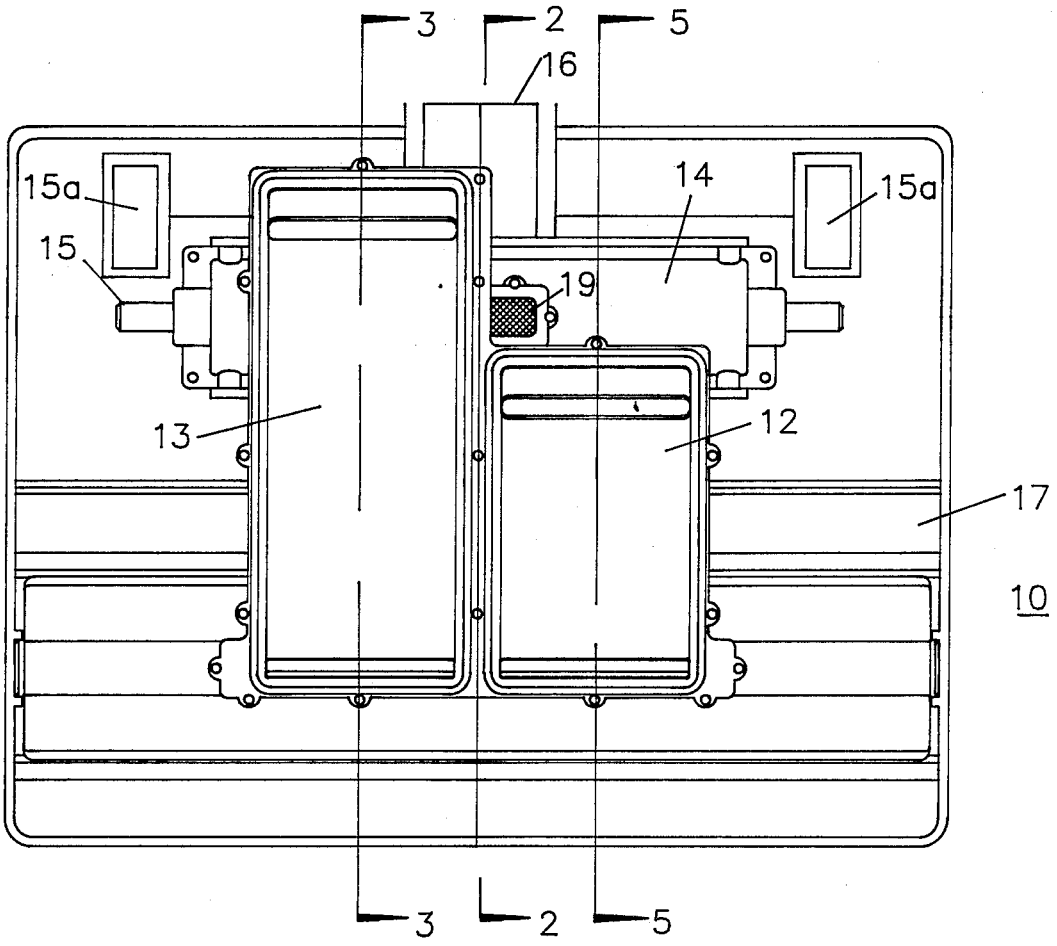
FIG. 1 is a top view of a vacuum apparatus of the present invention.

FIG. 1 is a top view of a vacuum apparatus 10 of the present invention. The vacuum apparatus has a housing 17 and is attached to a vacuum source by inlet 16. Inlet 16 pulls a vacuum through chambers 12 and 13. Housing 14 encloses a vacuum chamber and a rotary vane described below. The rotary vane may rotate or oscillate, as explained below, and is driven by a pulley (not illustrated) on shaft 15. A suction relief port in the vacuum chamber (described below) draws air through vent opening 19 in housing 14. A vacuum pick-up chamber and brush housing is indicated at 17.

Figure 2:
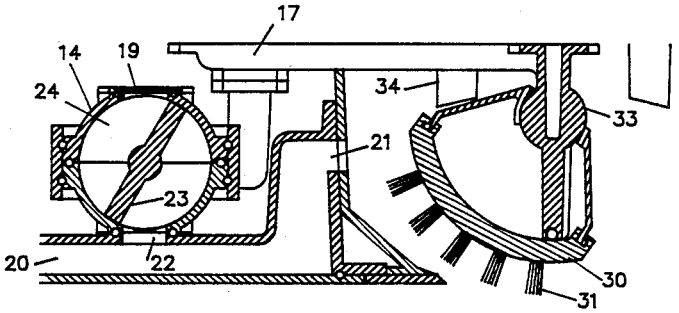
FIG. 2 is a partial cross-sectional view taken through section 2—2 of FIG. 1.

FIG. 2 is a modified cross-sectional view taken through section 2—2 of FIG. 1. The view is modified to the extent that the brush 30 is illustrated in two different positions. The positions are discussed below.

Figure 2A:
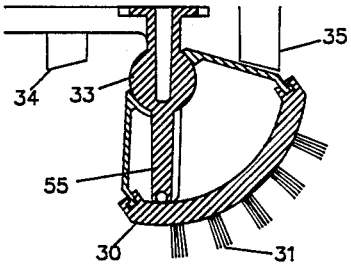
FIG. 2*a* is a partial cross-sectional view through section 2—2 illustrating the brush mechanism.

FIG. 2 shows the vacuum port 20 through which a vacuum is drawn. Brush 30 and bristles 31 sweep across the area being cleaned by the vacuum device, and dust and particles are drawn through opening 21 and out vacuum port 20. As brush 30 oscillates it engages stops 34 and 35. FIG. 2 shows the brush pulled to the left. FIG. 2*a* shows the brush pulled to the right. The alternate movement of the brush right and left, as viewed in FIGS. 2 and 2*a*, causes a sweeping motion to brush dust and dirt toward the vacuum intake of the vacuum device. The generation of this motion is explained below referencing the Figures of the drawings.

A part of the vacuum is drawn through opening 22 and creates a vacuum in chamber 24 which is directed to two different areas by vane 23 as it rotates or oscillates in chamber 24. Vane 23 is driven by the wheels of the vacuum device (not illustrated). The vane is connected to shaft 15 (FIG. 1) and connected to the wheels by an appropriate drive train (not illustrated).

As vane 23 oscillates or rotates in chamber 24, a vacuum is alternately created in two different chambers in brush 30. To allow the brush to oscillate, the vacuum must be broken in the first chamber in which a vacuum has just been created so that a vacuum can be created in the second chamber. When vane 23 is positioned to created a vacuum in the second chamber, the first chamber is vented through port 19 in the top of chamber 24, and housing 14.

Figure 3:
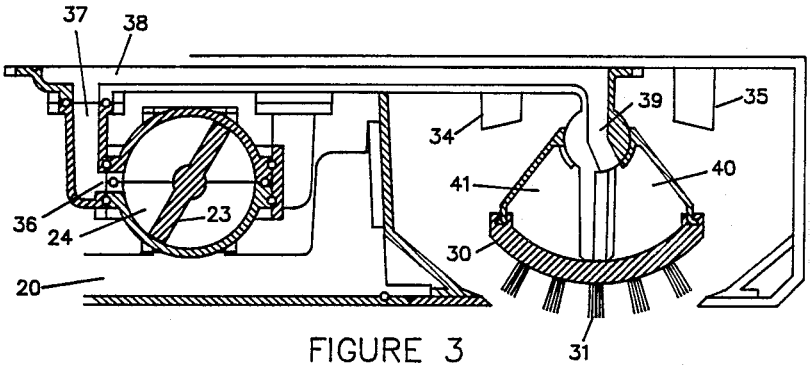
FIG. 3 is a cross-sectional view taken through section 4—4 of FIG. 1.

FIG. 3 is a complete cross sectional view across section 3—3 of FIG. 1. Brush 30 is shown in a non-tilted position. Brush 30 has two chambers 40 and 41 from which a vacuum is drawn as explained below. Vacuum chamber 24 in this view has an opening 36 connecting channels 37 and 38. Channel 38 also connects chamber 40 in brush 30 through channel 39.

Figure 4:
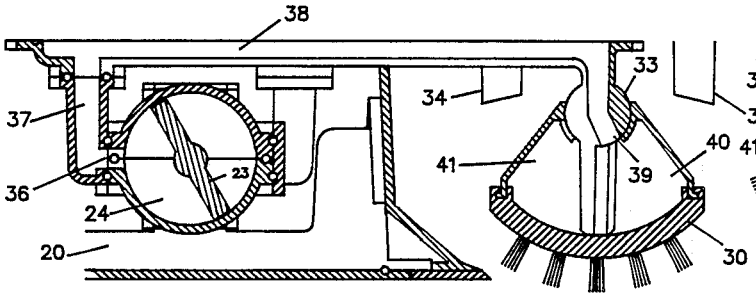
FIG. 4 is a partial cross-sectional view taken through section 4—4 of FIG. 1.
Figure 4A:
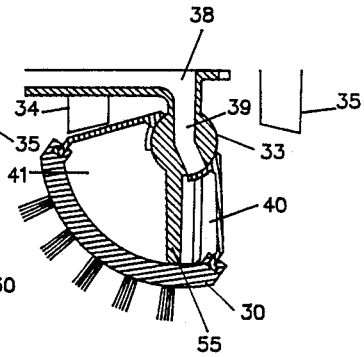
FIG. 4*a* is a partial cross-sectional view through section 4—4 illustrating the brush mechanism.

FIG. 4 is a partial cross-sectional view through section 3—3 of FIG. 1 with the addition of a second cross sectional view, FIG. 4*a*, of the brush in a second position.

The operation of the vacuum device to move the brush is as follows. A vacuum is drawn through vacuum inlet 20. Part of the vacuum is drawn through chamber 24 through opening 22 (see FIG. 2). Vane 23 is in a position to allow the vacuum to be drawn through opening 22 in the bottom of vacuum chamber 24, through opening 36 in the side of chamber 24, and then through channels 37, 38 and 39. Channel 39 opens into chamber 40 of brush 30 and pulls a vacuum in chamber 40. The vacuum in chamber 40 causes chamber 40 to pull toward fixed wall 55, and in doing so rotates brush 30 about a fixed ball joint 33.

Figure 5:
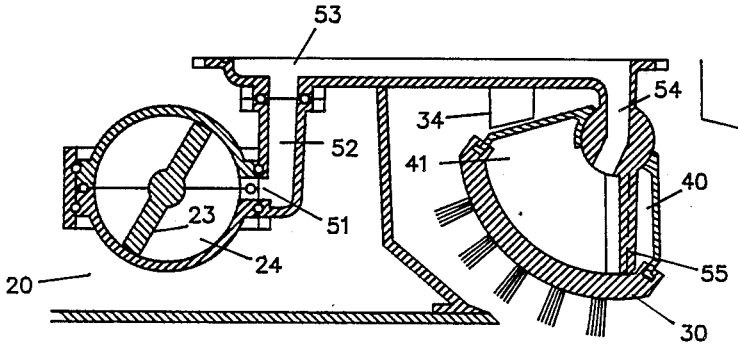
FIG. 5 is a partial cross-sectional view taken through section 5—5.
Figure 5A:
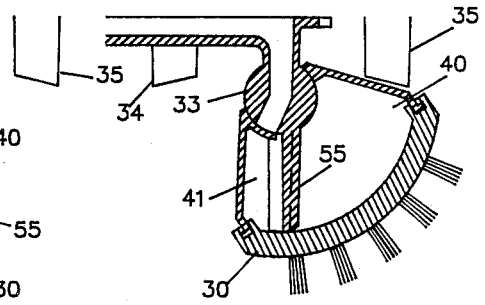
FIG. 5*a* is a partial cross-sectional view through section 5—5 of FIG. 1 illustrating the brush mechanism.

FIG. 5 is a cross-sectional view taken through section 5—5 of FIG. 1. FIG. 5 shows brush 30 drawn to the left as it was positioned in FIG. 4*a*, the brush being drawn to the left by the vacuum pulled in brush chamber 40. FIG. 5 shows that there is an opening 51 in vacuum chamber 24 which is connected to brush chamber 41 by channels 52, 53 and 54. When vane 23 in vacuum chamber 24 is in the position illustrated in FIG. 5, a vacuum is pulled thorough opening 22 (FIG. 2) in vacuum chamber 24, and through opening 51, and channels 52, 53, 54 and brush chamber 41. The vacuum created in brush chamber 41 causes brush chamber to pull towards fixed wall 55, moving the brush to the right as illustrated in FIG. 5*a*.

The alternate creation of vacuums in brush chambers 40 and 41 causes brush 30 to oscillate back and forth (right and left in the cross-sectional views in FIGS. 2–5) creating a sweeping action to sweep dust and dirt toward vacuum intake opening 21 (FIG. 2), and to generally help loosen dust and dirt, for example in carpets, to allow the dust and dirt to be drawn into the vacuum device vane 23 may either rotate or oscillate to alternately allow vacuums to be created in brush chambers 40 and 41, thus causing brush 30 to move in an oscillating manner. The motion of vane 23 is generated by the movement of wheels 15*a* of vacuum device 10, shaft 15 being connected to the wheels via shaft 15 (FIG. 1). An alternate method of moving vane 23 is to rotate or cause the vane to oscillate by a rotary mechanism (not illustrated) which is turned or rotated by the vacuum source.

Figure 6:
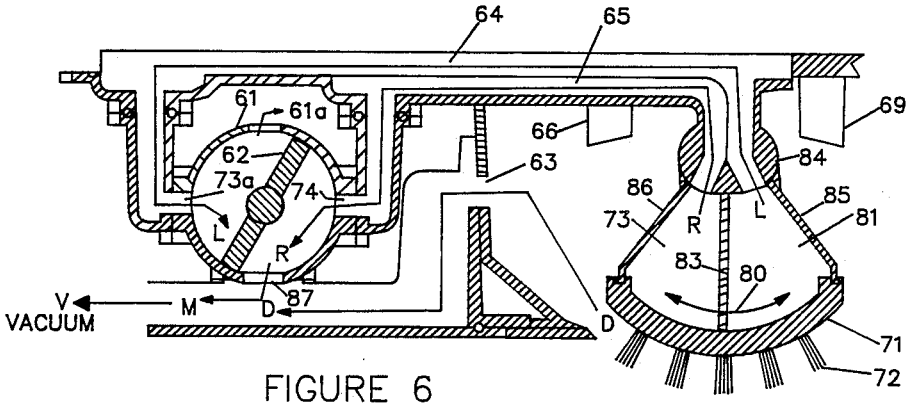
FIG. 6 is simplified illustration of the invention.

FIG. 6 is a simplified illustration of the invention. The vacuum chamber 61 is shown with an opening 86 in the bottom of the chamber and two openings, 73*a* and 74 in opposite sides of the chamber 61. As a vacuum is drawn there is air flow as indicated by arrow V pointing toward the vacuum source. The vacuum device picks up dust and dirt as indicated by the arrow D, the dust is picked-up at brush 71, flows through opening 63 to the vacuum source.

At the same time, a vacuum will be created in one of the brush chambers 73 or 81, depending upon the then location of rotating vane 62. In the position illustrated, a vacuum will be created in brush vacuum chamber 73. The vacuum is pulled from chamber 73 through passage 65, into vacuum chamber 61 through opening 74, out opening 87 to the vacuum source. The path of vacuum pulled is indicated by arrow R. When the vacuum is created in brush chamber 73, brush chamber wall 86 is pulled toward fixed wall 83 rotating the brush to the right (as viewed in FIG. 6). The motion of brush 71 is reversed when vane 62 in vacuum housing 61 rotates to allow a vacuum to be pulled through opening 73*a*, passage 64, and brush vacuum chamber 81. As the vacuum is created in chamber 81, the brush housing wall 85 is pulled toward fixed wall 83 rotating the brush to the left (as viewed in FIG. 6).

Vane 62 in vacuum chamber 61 may rotate or oscillate to alternately provide a path through openings, 87 and 74, or through openings 87 and 73*a*. As vane 62 oscillates, the vacuum in the vacuum chamber 73 and 81 are alternately relieved so that a vacuum may be created in the other chamber. As illustrated in FIG. 6, the vacuum in brush chamber 81 is being relieved through passage 64, port 73*a* and port 61*a* while a vacuum is being created in bush chamber 73 through passage 65, port 74 and port 87. As vane 62 rotates to created a vacuum in one brush chamber the vacuum in the other brush chamber is relieved port 61*a*, which vents through vent opening 19 (FIG. 1). As the paths are alternated, brush 71 and bristles 72 will oscillate as indicated by two headed arrow 80, indicating that the brush sweeps back and forth. Brush 71 oscillates about ball joint 84 and the upper ends of brush walls 85 and 86.

Movement of vane 62 may be caused by rotation of wheels 15*a*, FIG. 1, and may be either a rotation motion or oscillation motion as long as vane 62 alternately provides a vacuum path through openings 87 and 74 one time, and openings 87 and 73*a* the next time. Arrow M indicates that the vacuum flow out of vacuum chamber is through opening 86.

I claim:

1. A positive displacement air motor in a vacuum device for providing power to a brush device, comprising:

a vacuum source, a hollow brush device defining at least two variable volume chambers therein pivotably mounted on a shaft and separated by a fixed vane, a vacuum chamber, and an air control valve within said vacuum chamber, said air control valve being in fluid communication with said vacuum source and said variable volume chamber, wherein said air control valve and vacuum source alternately and oppositely create and release a vacuum in said at least two variable volume brush chamber to cause an alternately positive displacement of said brush device in two opposite directions as a result of expansion and contraction of each chamber relative to the fixed vane.

2. The air motor according to claim 1, wherein said air control valve is moved by connection to one or more wheels of the vacuum device.

3. The air motor according to claim 1, wherein the air flow control valve is a rotary valve.

4. The air motor according to claim 1, wherein the vacuum source provides air movement to the air motor at the same time the vacuum source is lifting and transporting dirt and other material.

5. The air motor according to claim 1, wherein said brush chambers have one movable wall and one fixed wall, and motion of said brush in one direction results when a vacuum is created in one of said brush chambers causing said movable wall to be drawn towards the fixed wall as the vacuum is created within said one brush chamber.

6. The air motor according to claim 5, wherein motion is caused in another direction when a vacuum is created in another of said brush chambers.

7. The air motor according to claim 1, wherein said brush device is pivotally mounted about an axis and is displaced about said axis in a pendulum type motion.

8. A positive displacement air motor in a vacuum device for providing power to a brush device, comprising:

a vacuum source, a hollow brush device pivotally mounted on a fixed shaft and defining therein at least two variable volume chambers separated by a fixed vane, a vacuum chamber, and an air control valve within said vacuum chamber, said air control valve being in fluid communication with said vacuum source and said variable volume chambers, wherein said air control valve and vacuum source alternately and oppositely create and release a vacuum in said at least two brush chambers to cause an alternating positive displacement of said pivotally mounted brush device in opposite directions about said shaft as a result of the creating and releasing of the vacuum in each chamber.

9. The air motor according to claim 8, wherein said air control valve is moved by connection to one or more wheels of the vacuum device.

10. The air motor according to claim 8, wherein the air flow control valve is a rotary valve.

11. The air motor according to claim 8, wherein the vacuum source provides air movement to the air motor at the same time the vacuum source is lifting and transporting dirt and other material.

12. The air motor according to claim 8, wherein said brush chambers have one movable wall and one fixed wall, and motion of said brush in one direction results when a vacuum is created in one of said brush chambers causing said movable wall to be drawn towards the fixed wall as the vacuum is created within said one brush chamber.

13. The air motor according to claim 12, wherein motion is caused in another direction when a vacuum is created in another of said brush chambers.

14. The air motor according to claim 8, wherein said brush device is displaced about said axis in a pendulum type motion.

* * * * *